US010306976B2

(12) United States Patent
Ranucci

(10) Patent No.: US 10,306,976 B2
(45) Date of Patent: Jun. 4, 2019

(54) BRUSH CLEANER AND METHOD OF USE

(71) Applicant: Michael J Ranucci, Auburn, ME (US)

(72) Inventor: Michael J Ranucci, Auburn, ME (US)

( * ) Notice: Subject to any disclaimer, the term of this patent is extended or adjusted under 35 U.S.C. 154(b) by 0 days.

(21) Appl. No.: 15/559,493

(22) PCT Filed: Jun. 16, 2017

(86) PCT No.: PCT/US2017/037830
§ 371 (c)(1),
(2) Date: Sep. 19, 2017

(87) PCT Pub. No.: WO2017/218869
PCT Pub. Date: Dec. 21, 2017

(65) Prior Publication Data

US 2018/0206629 A1 Jul. 26, 2018

Related U.S. Application Data

(60) Provisional application No. 62/351,245, filed on Jun. 16, 2016.

(51) Int. Cl.

| | |
|---|---|
| ***A46B 17/06*** | (2006.01) |
| ***A46B 17/00*** | (2006.01) |
| ***A46B 17/08*** | (2006.01) |
| ***B44D 3/00*** | (2006.01) |
| *B08B 3/08* | (2006.01) |

(52) U.S. Cl.
CPC ..... *A46B 17/06* (2013.01); *A46B 17/00* (2013.01); *A46B 17/08* (2013.01); *B44D 3/006* (2013.01); *A46B 2200/205* (2013.01); *B08B 3/08* (2013.01)

(58) Field of Classification Search
None
See application file for complete search history.

(56) References Cited

U.S. PATENT DOCUMENTS

| | | | |
|---|---|---|---|
| 323,420 | A | 8/1885 | Hills |
| 1,285,948 | A | 11/1918 | Cook |
| 1,689,209 | A | 10/1928 | Majewski |
| 2,827,647 | A | 3/1958 | Speer |
| 2,963,727 | A | 12/1960 | Roberts |
| 3,076,994 | A | 2/1963 | Zimmerman |
| 3,776,371 | A | 12/1973 | Linger |
| 4,494,267 | A | 1/1985 | Fredley |
| 4,660,245 | A | 4/1987 | Anderson |
| 4,827,554 | A | 5/1989 | Cain |
| D304,512 | S | 11/1989 | Byers et al. |
| 5,363,870 | A | 11/1994 | Doyon |
| 5,477,873 | A | 12/1995 | Ramsey et al. |

(Continued)

*Primary Examiner* — Brian D Keller
(74) *Attorney, Agent, or Firm* — Tredecim LLC; Sean L. Sweeney; Taylor A. Noonan

(57) ABSTRACT

The present invention is directed to a brush cleaning device that thoroughly and efficiently cleans brushes. The brush cleaning device comprises a main body having a base, wherein the interior of the base is substantially bowl-shaped; an insert, have a gross agitation surface and a fine agitation surface, wherein the insert fits within the base in a manner that forms a plurality of cleaning solution wells, each cleaning well substantially isolated from one another; and a lid, wherein the interior of the lid is substantially bowl-shaped and wherein the lid may be secured to the base in a manner that prevents the leakage of any cleaning fluid held within the base.

15 Claims, 6 Drawing Sheets

(56) References Cited

U.S. PATENT DOCUMENTS

| | | | | |
|---|---|---|---|---|
| 5,829,603 | A | 11/1998 | Martineau | |
| 2007/0221260 | A1 | 9/2007 | Watters et al. | |
| 2014/0083471 | A1 | 3/2014 | Lian Tangstad | |
| 2015/0052698 | A1 | 2/2015 | Fakier | |
| 2015/0296973 | A1* | 10/2015 | Leiker ..... | A46B 17/06<br>15/104.92 |

* cited by examiner

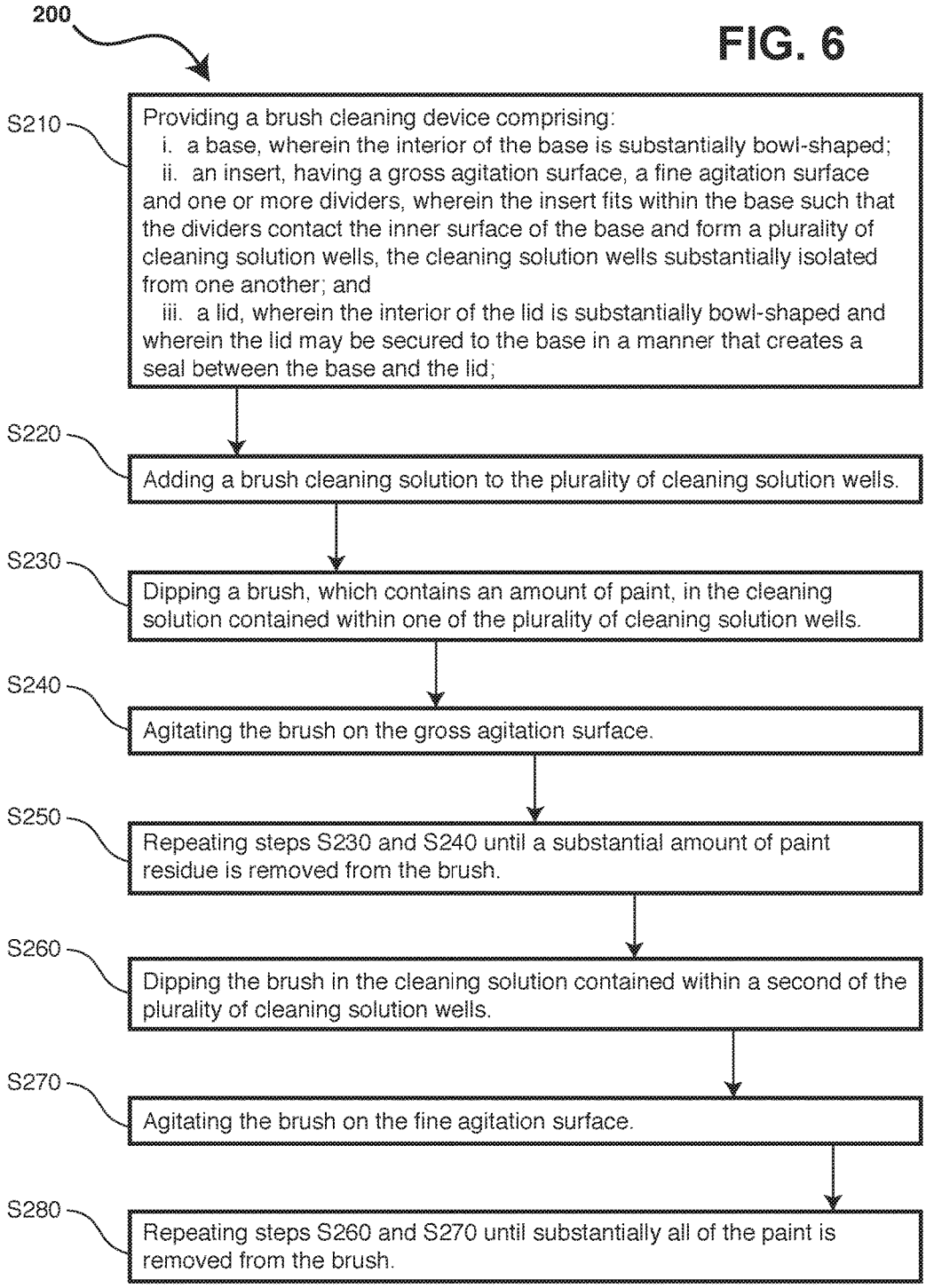
200
FIG. 6
S210
Providing a brush cleaning device comprising:
i. a base, wherein the interior of the base is substantially bowl-shaped;
ii. an insert, having a gross agitation surface, a fine agitation surface and one or more dividers, wherein the insert fits within the base such that the dividers contact the inner surface of the base and form a plurality of cleaning solution wells, the cleaning solution wells substantially isolated from one another; and
iii. a lid, wherein the interior of the lid is substantially bowl-shaped and wherein the lid may be secured to the base in a manner that creates a seal between the base and the lid;
S220
Adding a brush cleaning solution to the plurality of cleaning solution wells.
S230
Dipping a brush, which contains an amount of paint, in the cleaning solution contained within one of the plurality of cleaning solution wells.
S240
Agitating the brush on the gross agitation surface.
S250
Repeating steps S230 and S240 until a substantial amount of paint residue is removed from the brush.
S260
Dipping the brush in the cleaning solution contained within a second of the plurality of cleaning solution wells.
S270
Agitating the brush on the fine agitation surface.
S280
Repeating steps S260 and S270 until substantially all of the paint is removed from the brush.

BRUSH CLEANER AND METHOD OF USE

CROSS-REFERENCE TO RELATED APPLICATIONS

This application claims the benefit of U.S. Provisional Patent Application No. 62/351,245, filed Jun. 16, 2016, the disclosure of which is herein incorporated by reference.

BACKGROUND

1. Field of the Invention

The present invention pertains to the field of brush cleaning devices. Specifically, this invention relates to a novel brush cleaning device and method that allows artists and other individuals to efficiently and effectively clean their brushes after use.

2. Discussion of Background Information

The problem of effectively cleaning paint brushes is well known. In addition, other small brushes, such as cosmetics brushes, have similar cleaning needs in order to maintain the quality of the brush and extend its lifespan.

Brushes can be generally categorized as natural, synthetic or blended, based on the hair type. Natural hair, as the name implies, is natural hair from an animal. One common natural hair used in brushes is bristle, which comes from hog hair. Natural hog bristle brushes are the work horse for quality-conscience artists. The best of these are carefully cut to preserve the split ends, referred to as "flags," and often assembled in such a way that they interlock toward the tip. The microscopic flags are at the end of the bristle hairs and allow the brush to hold more paint and spread it more evenly. However, the flags can be easily damaged if the brush is abused—such as scraping too harshly. In addition, ineffective cleaning techniques can accelerate the deterioration of the flags and shorten the lifespan of the brush. Cheaper bristle brushes, which are commonly referred to as student grade, are not cut to preserve the flags. Student grade brushes are just natural hog bristles typically cut and assembled in the most convenient and cost effective way possible.

Another common natural hair used in brushes is sable. Natural sable brushes are usually used for fine detail, blending, or glazing. These brushes are very delicate and susceptible to damage. While often similar to sable brushes in use, synthetic brushes are not as effective in most cases and are considered inferior in most applications. Synthetic brushes are, however, generally more durable than the delicate sable brushes.

Regardless of the hair type, all brushes benefit from careful and thorough cleaning in order to preserve the intended quality of the brush and to extend the length of the brush's useful life. Not surprisingly, prior devices attempt to provide solutions to the problem of brush cleaning. However, existing brush cleaning devices invariably suffer from a collection of maladies.

A common problem with existing brush cleaning devices is that the devices utilize cleaning methods where the cleaning solution quickly becomes dirty as the paint released during the cleaning process accumulates in the cleaning solution. As released paint continues to accumulate, the effectiveness of the cleaning device is reduced. In addition, existing devices rely on a single agitation surface placed either within or just above the fluid reservoir to clean brushes. This configuration exacerbates the problem of quickly soiling the cleaning solution and limits the range of brushes that can be adequately cleaned with the device. Some existing devices also rely on agitation surfaces that resemble a scouring pad, or which include sharp edged textures. While these textured surfaces provide agitation, they risk damaging the brush and shortening its lifespan.

In addition to poor design of the agitation surface and the cleaning solution reservoir, existing brush cleaning devices are extremely difficult to clean. As paint accumulates in the cleaning solution, it initially creates a suspension. In time, however, the released paint will settle to the bottom of the cleaning device, forming a layer of sediment. If this sediment is not removed, it can reenter suspension during the next cleaning event, further accelerating the deterioration of the cleaning efficacy of the brush cleaning device. Despite the importance of removing the sediment, prior designs are exceedingly difficult to clean effectively. In some devices, the sediment forms below the agitation surface and is not fully accessible during cleaning. In other devices, the sediment is accessible for cleaning, but the device includes corners and other sharp features that make it difficult, if not impossible, to remove the sediment completely.

A further flaw in prior designs is inadequate cover or lid design. Some cleaning solutions evaporate quickly and, therefore, require storage in a sealed container. A common method for addressing this problem is to utilize a cover that screws onto the cleaning device. While this approach works initially, once the brush cleaner has been used, the threaded section of the container and/or the lid become coated in paint. If this paint dries while the top is secured to the cleaning device, the paint serves as a glue that makes removal of the lid exceedingly difficult. In the worst situations, the lid becomes completely fused to the container, rendering the cleaning device unusable.

Ineffective brush cleaning has implications that reach beyond brush life. Many paints contain chemicals such as metals and solvents that are harmful to humans and the environment. In addition, cleaning solutions can contain additional harmful chemicals. These chemicals must be handled and disposed of in an appropriate manner. However, many brushes undergo at least a final cleaning step under the running water of a sink because the efficacy of existing brush cleaning devices quickly deteriorates to the point where they are incapable of achieving a thoroughly clean brush. Cleaning a brush in a sink is fraught with problems. Environmentally, cleaning a brush in a sink can result in harmful chemicals being released into the environment. In addition, users often rub the brush with bare hands while cleaning the brush in a sink. This activity results in direct exposure to the harmful chemicals often found in the paint and solvent that is held by the brush after an initial cleaning attempt. These exposures can be completely eliminated by utilizing a brush cleaning device capable of thoroughly and efficiently cleaning the brushes.

U.S. Pat. No. 3,076,994 to Zimmerman discloses an example of an existing brush cleaning device. The Zimmerman device utilizes a cup with a spirally coiled wire placed at the bottom in a manner where the cleaning portion of the coiled wire is raised above the bottom of the container. In practice, the device is filled with sufficient cleaning solution to submerge the coiled wire completely and a dirty brush is then agitated against the coil to remove the paint. This approach suffers from several disadvantages. First, because the coiled wire is submerged, as paint is removed from the brush, it quickly clouds the cleaning solution. As described above, the released paint will quickly accumulate, reducing the cleaning ability of the device. This is especially troublesome where multiple brushes must be cleaned in a single session. In addition, even if a user waits for the removed paint to settle to the bottom of the container, removing the sediment is a cumbersome process. First, the coiled wire itself must be removed and cleaned, which is a difficult process that risks damaging or deforming the coiled wire. Once the coiled wire is cleaned, the user must also remove the sediment from the bottom of the container. However, complete removal of the sediment is hindered by the fact that sediment has a tendency to accumulate where the container wall meets the container bottom, and this location is difficult to clean effectively. The inevitable result of this difficult cleaning process is that the user is forced to replace their cleaning solution much more frequently, which wastes cleaning solution and may become costly.

Another example of an existing brush cleaning device is found in U.S. Pat. No. 4,494,267 to Fredley. The Fredley device is a combined artist kit and brush cleaning device that utilizes a splatter bar to perform brush cleaning. Where a splatter bar is employed, the brush is cleaned by rapidly moving the brush across the splatter bar. Such action subjects delicate brushes to significant abrasive force on the sharp edges of the splatter bar, which can damage the brush and shorten its lifespan. Even if the brush is moved slowly across the Fredley splatter bar, the fact that the splatter bar utilizes only one reservoir of cleaning fluid means that the fluid will quickly become dirty, reducing the cleaning ability of the device. In addition, the closed nature of the device and the tight corners present below the splatter bar make it susceptible to the cleaning challenges described above. In another embodiment, the Fredley device utilizes a float in place of the splatter bar. However, this embodiment suffers from similar issues because the float is submerged in the cleaning solution, quickly dirtying the cleaning solution and reducing the effectiveness of the device. Moreover, the float further complicates cleaning of the device, obscuring the bottom of the device and making it difficult to adequately remove sediment once the cleaning solution has an opportunity to settle.

While other devices and methods have been proposed for cleaning paint brushes, none of these inventions, taken either singly or in combination, adequately address or resolve the aforementioned problems. Therefore, a need exists for an efficient device and method for thoroughly cleaning paint brushes.

SUMMARY OF THE INVENTION

The present invention solves the problems associated with brush cleaning and provides a device and method for thoroughly and efficiently cleaning paint brushes.

The present invention is directed to a brush cleaning device that enables the user to thoroughly and efficiently clean brushes. The brush cleaning device comprises a main body having a base, wherein the interior of the base is substantially bowl-shaped; an insert, having a gross agitation surface and a fine agitation surface, wherein the insert fits within the base in a manner that forms a plurality of cleaning solution wells, each cleaning well substantially isolated from one another; and a lid, wherein the interior of the lid is substantially bowl-shaped and wherein the lid may be secured to the base in a manner that prevents the leakage of any cleaning fluid held within the base.

The present invention is also directed to a method for thoroughly and efficiently cleaning a soiled brush. The method comprises providing a brush cleaning device and adding a brush cleaning solution to the plurality of cleaning solution wells. The user then dips a brush, which contains an amount of paint, in the cleaning solution contained within one of the plurality of cleaning solution wells and agitates the brush on the gross agitation surface. The steps of dipping the brush and agitating on the gross agitation surface are repeated until a substantial amount of paint residue is removed from the brush. Following agitation on the gross agitation surface, the user dips the brush in the cleaning solution contained within a second of the plurality of cleaning solution wells and agitates the brush on the fine agitation surface. Again, the steps of dipping in the second cleaning solution well and agitating of the fine agitation surface is repeated, this time until substantially all of the paint is removed from the brush.

BRIEF DESCRIPTION OF THE DRAWINGS

These and other features, aspects and advantages of the present invention will become better understood with reference to the following description, appended claims, and accompanying drawings where:

FIG. 6 shows the steps of one method of the present invention.

DETAILED DESCRIPTION OF THE INVENTION

The present device and method is directed to the problem of cleaning paint and other substances from brushes after use. Specifically, the present invention provides a device comprised of multiple agitation surfaces and multiple cleaning solution reservoirs, and a method of use that thoroughly and efficiently cleans paint from brushes after use.

The present invention addresses the problems surrounding the thorough cleaning of brushes. Artists and other brush users are unlikely to use devices that do not adequately clean a number of brushes. The present invention addresses these needs by providing a device that thoroughly and efficiently cleans multiple brushes in a manner that extends the life of the brushes, minimizes cleaning solution use, and enables proper disposal of the paint sediment.

Figure 1:
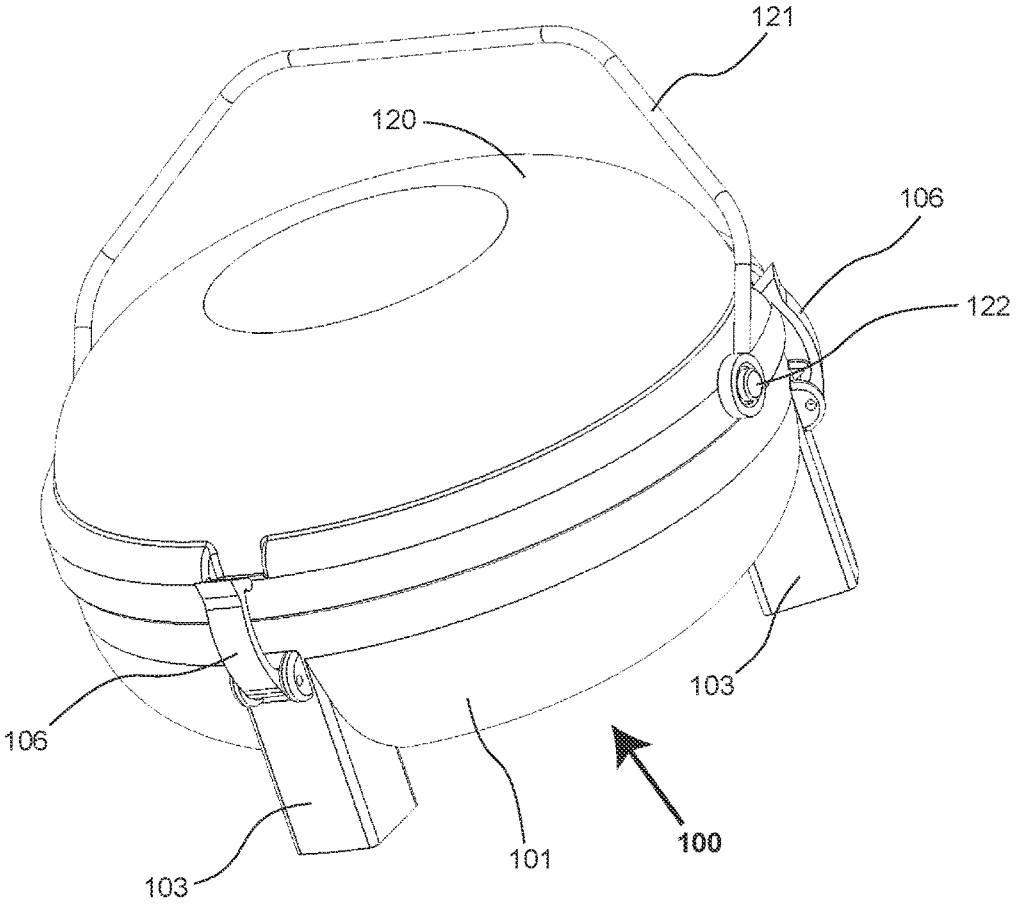
FIG. 1 is a perspective view of an embodiment of a brush cleaning device of the present invention.

Turning to FIG. 1, a brush cleaning device 100 of the present invention is shown. The brush cleaning device 100 includes a base 101 and a lid 120, which are sized and shaped to mate together. The lid 120 is depicted secured to the base 101 using a securing device 106. As depicted, the securing device 106 is a clip, however, a person of skill will appreciate that the lid 120 may secured using any securing device 106 known in the art, including myriad forms of clips and latches. The base may include a plurality of feet 103 to provide a stable platform for the brush cleaning device 100 when in use. While the lower portion of the base 101 is shaped like a shallow bowl to facilitate easy cleaning, the upper portion of the base 101 may be of any shape provided that the base 101 mates with the lid 120 to create a seal. Preferably, the seal between the base and the lid is a tight seal that prevents leakage of the cleaning solution.

Figure 2:
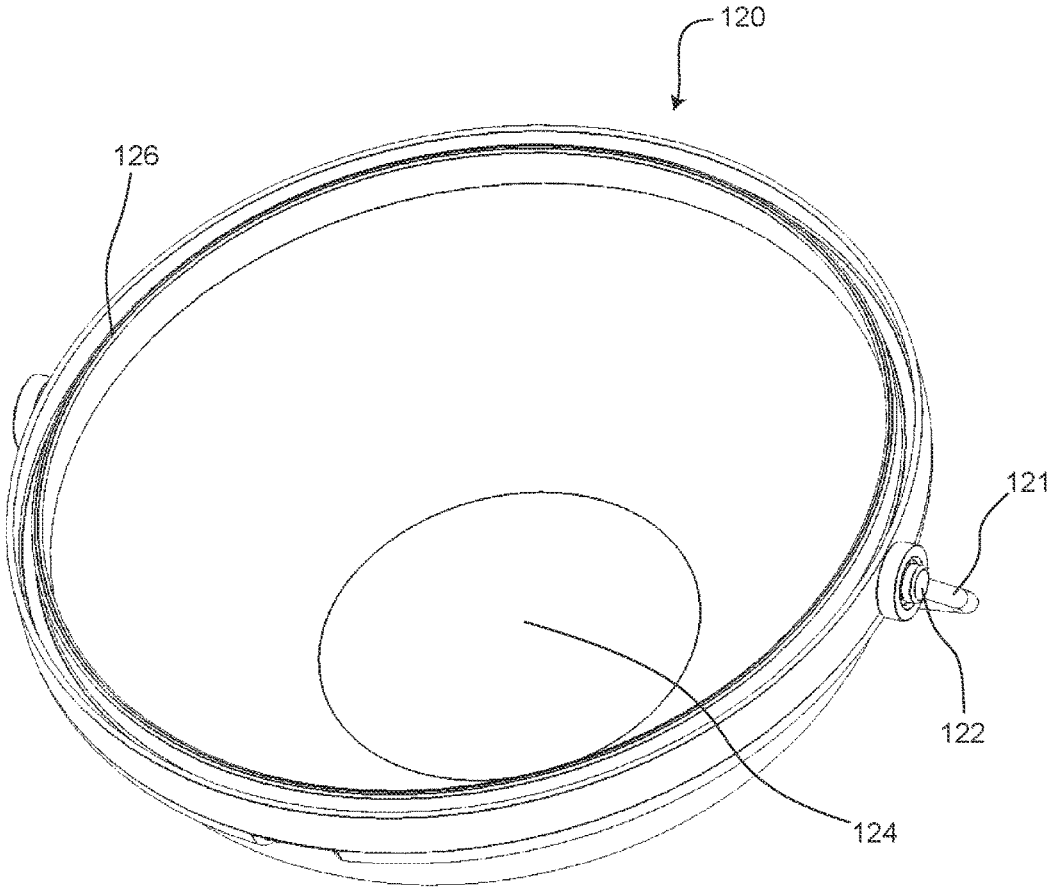
FIG. 2 is a perspective view of the inside of the lid of an embodiment of a brush cleaning device of the present invention.

As shown in FIG. 2, the lid 120 may include a gasket 126 to ensure a tight seal when the lid 120 is secured to the base 101. In addition, to serving as a tight-sealing cover, the lid 120 can hold cleaning solution while the user is cleaning sediment from the brush cleaning device 100. A substantially flat section 124 in the top of the lid 120 provides a stable platform for the lid 120 to sit upside down on a counter or tabletop. In this position, the lid 120 becomes a bowl that can serve as an auxiliary reservoir to hold cleaning solution while removing sediment from the brush cleaning device 100.

A handle 121 may be included to facilitate transportation of the brush cleaning device. While the handle 121 is depicted attached to the lid 120 using a pair of handle attachments 122, alternatively the handle 121 may be attached to the base 101 without deviating from the scope of the present invention. In the embodiment depicted in FIG. 2, the handle 121 is secured to the lid 120 via an aperture that is sized to fit over a protrusion functioning as the handle attachment point 122. However, the handle 121 may be secured using a screw or other fastener, or any other means known in the art that would permit the handle 121 to rotate about the attachment point 122. Rotation of the handle 121 facilitates transport of the brush cleaning device 100, minimizes the risk that cleaning solution will spill, and does not interfere with the use of the lid 120 as a bowl.

Figure 3:
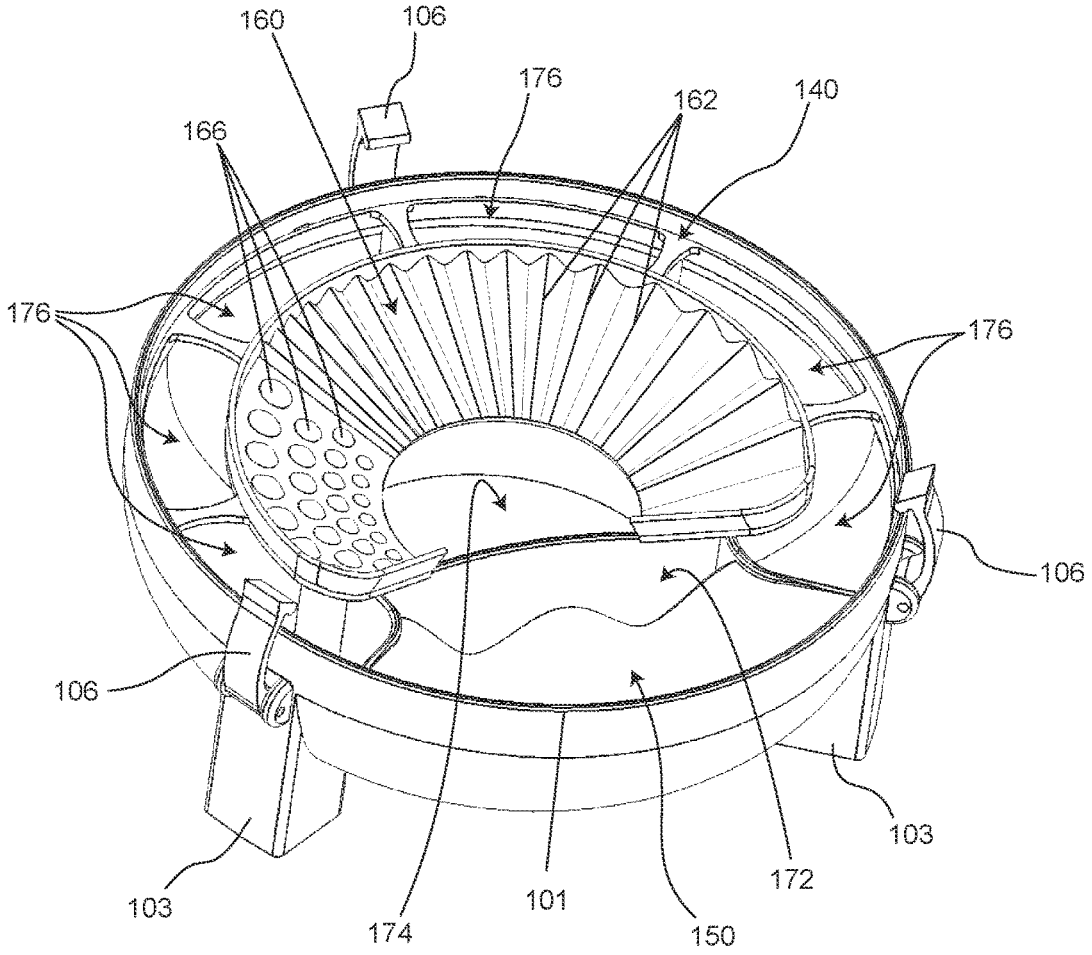
FIG. 3 is a perspective view of the interior of the base portion of an embodiment of a brush cleaning device of the present invention.

Turning to FIG. 3, the base 101 is depicted with the lid 120 removed. Inside the base 101 is an insert 140, which includes a plurality of agitation surfaces. The gross agitation surface 150 performs initial brush cleaning by providing an area where the user can quickly remove a significant portion of the paint from a used brush. Below the gross agitation surface 150 is the gross agitation well 172, which contains cleaning solution. The gross agitation surface 150 is angled so that any paint and cleaning solution removed from the brush during agitation against the gross agitation surface will drain into the gross agitation well 172. In addition, the gross agitation surface 150 may extend into the gross agitation well 172 a sufficient distance that the gross agitation surface 150 is partial submerged in cleaning solution. When partially submerged, the initial cleaning step may be more efficiently performed since the brush is agitated in the presence of cleaning solution.

The gross agitation surface 150 is depicted as having contoured ridges to assist with the agitation of the brush. However, the gross agitation surface 150 may be flat, or may include more aggressive ridges without deviating from the scope of the present invention. Further, while the gross agitation surface 150 is depicted as smooth, it may include one or more textured surfaces to further agitate the brush during when cleaning.

In addition to the gross agitation surface 150, the insert 140 includes a fine agitation surface 160. The fine agitation surface is positioned above a fine agitation well 174, which contains cleaning solution. Similar to the gross agitation surface 150, the fine agitation surface 160 is angled so that any paint or cleaning solution removed from the brush runs into the fine agitation well 174. The fine agitation well 174 is substantially isolated from the gross agitation well 172 in order to avoid contamination of the cleaning solution in the fine agitation well 174 while the user is cleaning the brush on the gross agitation surface 150. In addition, the fine agitation surface 160 may extend into the fine agitation well 174 a sufficient distance that the fine agitation surface 160 is partial submerged in cleaning solution in order to provide the opportunity to continue agitating the brush in the presence of cleaning solution.

The fine agitation surface 160 may be smooth or it may include one or more textured surfaces, which may include ridges 162, raised dimples 166, or other textured surfaces known in the art. These textured surfaces can be selected based on their ability to be sympathetic to the brush in order to minimize brush damage during cleaning. For example, raised dimples 166 are ideally suited for agitating delicate brushes and may be of varying size in order to accommodate various brush sizes. Similarly, ridges 162 are well suited for cleaning bristle brushes and may be of varied size to accommodate various brush sizes. FIG. 3 depicts one possible configuration of the fine agitation surface 160, where multiple textured surfaces are present such that the fine agitation surface 160 includes dimples 166 and ridges 162, each in varying sizes.

The fine agitation surface 160 may form a texture ring, where a plurality of texture surfaces are arranged in a semicircular shape. For example, the raised dimples 166 shown in FIG. 3 are arranged in horizontal rows, where the size of the raised dimples 166 is largest at the upper portion of the fine agitation surface 160 and grows progressively smaller as you move down the fine agitation surface 160. Alternative arrangements, such as where the raised dimples 166 are arranged in the opposite order, with the rows of raised dimples 166 progressing from smallest to largest as you move down the fine agitation surface 166, are also possible. Indeed, the raised dimples 166 may also be arranged in multiple columns of various sized raised dimples 166, with the size of the raised dimples 166 in each column remaining constant from the top edge of the fine agitation surface 160 down toward the fine agitation well 174.

Ridges 162 may also vary in size to accommodate a variety of brush sizes. As shown in FIG. 3, the ridges 162 may grow progressively larger in size and wider in spacing as they extend across the face of the fine agitation surface 160. In selecting the appropriate shape for the ridges 162, it is important to note that sharp ridges 162 can be unnecessarily abrasive and may lead to shortened brush life. In contrast, rounded ridges 162, which are also tapered at the bottom, strike a balance between abrasion and delicacy, providing good cleaning action without damaging the brush.

As explained above, the rapid clouding of the cleaning solution is a significant drawback of existing brush cleaning devices. The present invention addresses this concern by utilizing a plurality of substantially isolated agitation wells. In addition to the previously described gross agitation well 172 and fine agitation well 174, the invention may include one or more additional cleaning solution wells 176. With continued reference to FIG. 3, a series of additional cleaning solution wells 176 are located near the perimeter of the base 101. These additional cleaning solution wells 176 are substantially isolated from each other, and substantially isolated from the gross agitation well 172 and the fine agitation well 174. As a result, the cleaning solution in the additional cleaning solution wells 176 is not contaminated by the paint released into either the gross agitation well 172 or the fine agitation well 174. The additional cleaning solution wells 176 provide ready access to clear cleaning solution, even after the gross agitation well 172 and the fine agitation well 174 have been clouded with paint.

Figure 4:
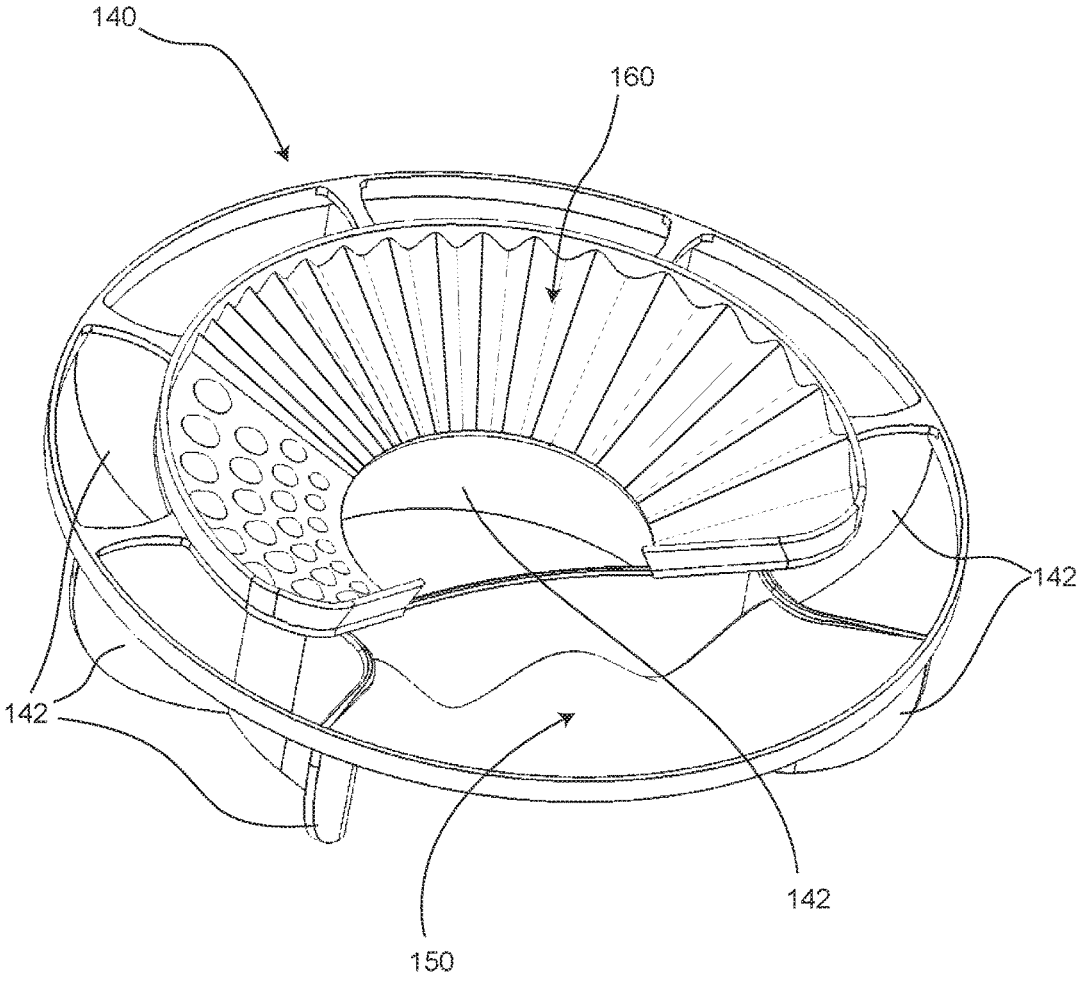
FIG. 4 is a top perspective view of an embodiment of the insert of a brush cleaning device present invention.
Figure 5:
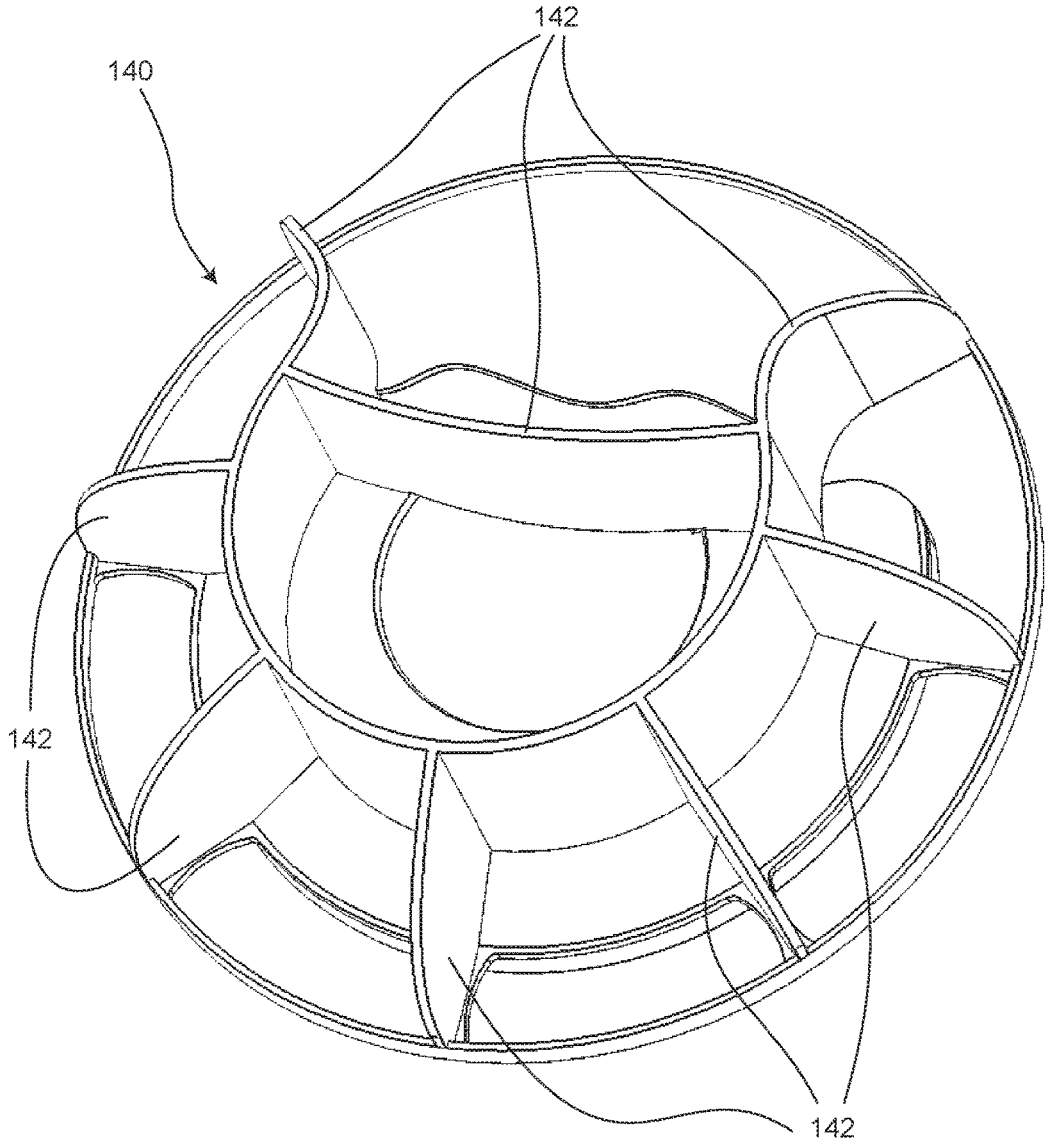
FIG. 5 is a bottom perspective view of an embodiment of the insert of a brush cleaning device present invention.

Turning to FIGS. 4 and 5, the inset 140 is removable and is shown separated from the base 101. The insert includes dividers 142, sized and shaped to substantially mirror the curvature of the interior of the base 101. Once the insert 140 is placed within the base 101, the dividers 142 contact the interior surface of the base 101 and create a physical barrier between the various cleaning solution wells.

Due to the substantial isolation created by the dividers 142, cleaning solution is restricted from moving between cleaning solution wells. As a result, the gross agitation well 172 can accumulate a substantial amount of paint without contaminating the fine agitation well 174. Similarly, as the fine agitation well 174 accumulates paint and becomes cloudy, the additional cleaning solution wells 176 remain substantially clear. This segregation of the cleaning solution allows the brush cleaning device 100 to clean substantially more brushes during a cleaning session because it prolongs the availability of substantially clear cleaning solution. In addition, the brush cleaning device 100 may be used for multiple brush cleaning sessions before the brush cleaning device 100 itself requires cleaning.

In order to prepare the brush cleaning device 100 for cleaning a brush, the preferred brush cleaning solution must be added to the cleaning solution wells. While there is no minimum level for the cleaning solution, it is important not to fill the cleaning solution wells to the point where the cleaning solution is above the top of the dividers 142 and able to easily migrate between cleaning solution wells. Once the cleaning solution is added to the brush cleaning device 100, the user can start cleaning a brush by dipping the brush in the gross agitation well 172 and agitating the brush against the gross agitation surface 150. Due to the soft curvature of the gross agitation surface 150, the user can be fairly aggressive with the agitation at this stages. However, it is prudent to agitate the brush in a horizontal direction to avoid vigorously rubbing the brush against the lower edge of the gross agitation surface 150. In addition, in embodiments where the gross agitation surface 150 extends into the gross agitation well 172, it is often advantageous to alternate between agitating the brush against the gross agitation surface 150, with the brush submerged in the cleaning solution, and agitating the brush against the gross agitation surface 150, with the brush above the level of the cleaning solution. Agitation on the gross agitation surface 150 removes a substantial amount of paint from the brush. As a result, the cleaning solution in the gross agitation well 172 will quickly become clouded with removed paint.

If the user is alternating between agitating above and below the surface of the cleaning solution while using the gross agitation surface 150, it will be evident when a substantial amount of paint has been removed from the brush by observing the runoff while the brush is agitated above the cleaning solution level. Specifically, as paint is removed, the runoff will become increasingly clear, alerting the user to move to the fine agitation surface 160.

In embodiments where the fine agitation surface 160 includes one or more textured surfaces, the user can select the portion of the fine agitation surface 160 that best suits the brush being cleaned. For example, if the user is cleaning a delicate sable brush, the user will likely want to use a raised dimple 166 section.

After dipping the brush in the fine agitation well 174, the brush is agitated against the chosen portion of the fine agitation surface 160. Again, agitation is often best performed in a horizontal direction to avoid damaging the brush by rubbing the brush against the lower edge of the fine agitation surface 160. By successively dipping the brush in the fine agitation well 174 and agitating against the chosen section of the fine agitation surface 160, the brush can be substantially cleaned. Indeed, the progress of the cleaning process is easily monitored by observing the clarity of the runoff while the brush is agitated against the fine agitation surface 160.

In some situations, the brush will be sufficiently clean after agitation against the gross agitation surface 150 and use of the fine agitation well 174 cleaning solution and the fine agitation surface 160. However, in situations where the cleaning solution in the fine agitation well 174 has become excessively cloudy, or in situations where the brush simply requires additional cleaning, the user can utilize the additional cleaning wells 176. Even after the gross agitation well 172 and the fine agitation well 174 become cloudy, the additional cleaning solution wells 176 remain substantially clear. Therefore, the user can dip the brush in one of the additional cleaning solution wells 176 and continue to agitate the brush on the chosen section of the fine agitation surface 160. When using the additional cleaning solution wells 176, it is important to keep the brush out of the cloudier cleaning solution of the fine agitation well 174 by agitating the brush on a portion of the fine agitation surface 160 that is above the level of the cleaning solution in the fine agitation well 174. The user can continue to monitor progress of the cleaning process by observing the clarity of the runoff as the brush is agitated against the fine agitation surface 160. Use of the additional cleaning solution wells 176, in conjunction with agitation on the fine agitation surface 160, can be continued until the brush is completely clean.

In addition to the above steps, the user may wish to wipe the brush on a rag between using the gross agitation surface 150, the fine agitation surface 160, or the additional cleaning solution wells 176. Using a rag is a valuable additional way to gauge cleanliness of the brush and can serve to remove a small amount of paint between each step in the cleaning process.

Unlike prior designs, cleaning sediment from the brush cleaning device is a simple process. After waiting a sufficient amount of time for paint to settle on the bottom of the base 101, the insert 140 can be removed, which leaves a layer of sediment on the bottom of the base 101. At this point, the lid 120 can be inverted to form a bowl and the cleaning solution can be poured off into the lid 120. The sediment on the bottom of the base 101 will ordinarily stay in place as the cleaning solution is poured off into the lid 120. However, it is advisable to pour the cleaning solution slowly and carefully to avoid agitating the cleaning solution and releasing some of the sediment back into solution. Unlike prior designs, once the cleaning solution has been transferred to the lid 120, the base 101 is easily wiped out using a rag due to the fact that the lower portion of the base 101 is shaped like a shallow bowl. Once the base 101 is wiped clean, the rag and sediment can be properly disposed of in accordance with the chemicals contained in the paint and cleaning solution.

Because the dividers 142 rest against the edge of the base 101, they sometimes accumulate sediment on their edges. Therefore, in addition to cleaning the sediment from the bowl, it is sometimes necessary to wipe the lower edge of the dividers 142. When cleaning the divider 142 edges is required, they can be easily wiped clean with a rag.

Once the base 101 and the divider 142 edges are clean, the insert 140 can be placed back in the base 101 and the cleaning solution can be poured back into the base 101 from the lid 120. In many instances, very little cleaning solution will be lost during the cleaning process. However, if necessary, the user may add additional cleaning solution to fill the cleaning solution wells to the desired level.

Turning to FIG. 6, a method 200 for using a brush cleaning device 100 to clean a brush is depicted. A first step S210 comprises providing a brush cleaning device 100. A second step S220 comprises adding brush cleaning solution to the plurality of cleaning solution wells, which may include the gross agitation well 172, the fine agitation well 174 or the additional agitation wells 176. A third step S230 comprises dipping a brush, which contains an amount of paint, in the cleaning solution contained within one of the plurality of cleaning solution wells, followed by a fourth step S240 comprising agitating the brush on the gross agitation surface 150. Depending on how soiled the brush is, a fifth step S250 comprises repeating steps S220 and S240 until a substantial amount of paint residue is removed from the brush. Once a substantial amount of paint is removed from the brush, a sixth step S260 comprises dipping the brush in the cleaning solution contained within a second of the plurality of cleaning solution wells, followed by a seventh step S270 comprising agitating the brush on the fine agitation surface 160. Again, depending on how soiled the brush is, an eighth step S280 comprises repeating steps S260 and S270 until substantially all of the paint is removed from the brush. Once substantially all of the paint is removed from the brush, the user may utilize an additional cleaning solution well 176 for a final rinse of the brush or the user may simply wipe the brush on a clean rag to complete cleaning.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A brush cleaning device comprising:

a. a concave base having a curved inner surface;

b. a removable insert disposed within the base, the removable insert comprising an upper portion and a lower portion extending below the upper portion, i. wherein the lower portion of the removable insert comprises a gross agitation surface and a plurality of dividers, at least one of the plurality of dividers directly contacting the upper portion, ii. wherein each of the plurality of dividers comprises a base contact edge that substantially mirrors the inner surface of the base and a wall portion extending from the base contact edge toward the upper portion, iii. wherein the base contact edge of each of the plurality of dividers is in substantial contact with the inner surface of the base to define a plurality of cleaning solution wells such that fluid in each cleaning solution well is in direct contact with at least one divider and the inner surface of the base, iv. wherein the plurality of cleaning solution wells includes at least:

A. a gross agitation well extending directly below the gross agitation surface,

B. a fine agitation well extending directly below a fine agitation surface, and

C. one additional cleaning solution well, v. wherein the gross agitation surface contacts the at least one divider defining the gross agitation well, is angled toward the gross agitation well, and includes an edge disposed in or disposed directly above the gross agitation well such that paint and cleaning solution expelled from a brush on the gross agitation surface is directed into the gross agitation well, vi. wherein the upper portion of the removable insert includes the fine agitation surface, the fine agitation surface including one or more textured surfaces comprising protrusions and being sloped from an upper edge toward the lower portion and terminating at a lower edge, and wherein the entirety of the lower edge is disposed with respect to the fine agitation well such that paint and cleaning solution expelled from a brush on the fine agitation surface is directed into the fine agitation well, and vii. wherein the dividers defining the plurality of cleaning solution wells contact the inner surface of the base along a sufficient length of their respective base contact edges to substantially isolate each of the plurality of cleaning solution wells such that paint released from a brush into any of the plurality of cleaning solution wells is substantially prevented from contaminating any of the other of the plurality of cleaning solution wells; and c. a lid, wherein the lid and the base are configured to create a seal.

2. The brush cleaning device of claim 1 wherein the protrusions include raised dimples.

3. The brush cleaning device of claim 1 wherein the protrusions include ridges.

4. The brush cleaning device of claim 1 wherein the protrusions include a combination of ridges and raised dimples.

5. The brush cleaning device of claim 1 further comprising one or more securing devices wherein the one or more securing devices secure the lid to the base to maintain the seal.

6. The brush cleaning device of claim 5 wherein the one or more securing devices are one or more clips.

7. The brush cleaning device of claim 1 further comprising a plurality of feet.

8. The brush cleaning device of claim 1 wherein the lid has a substantially bowl-shaped inner surface and is removably secured to the base.

9. A method for cleaning a brush comprising:

a. providing a brush cleaning device comprising:

i. a concave base having a curved inner surface;

ii. a removable insert disposed within the base, the removable insert comprising an upper portion and a lower portion extending below the upper portion, A. wherein the lower portion of the removable insert comprises a gross agitation surface and a plurality of dividers, at least one of the plurality of dividers directly contacting the upper portion, B. wherein each of the plurality of dividers comprises a base contact edge that substantially mirrors the inner surface of the base and a wall portion extending from the base contact edge toward the upper portion, C. wherein the base contact edge of each of the plurality of dividers is in substantial contact with the inner surface of the base to define a plurality of cleaning solution wells such that fluid in each cleaning solution well is in direct contact with at least one divider and the inner surface of the base, D. wherein the plurality of cleaning solution wells includes at least:

1. a gross agitation well extending directly below the gross agitation surface,
2. a fine agitation well extending directly below a fine agitation surface, and
3. one additional cleaning solution well, E. wherein the gross agitation surface contacts the at least one divider defining the gross agitation well, is angled toward the gross agitation well, and includes an edge disposed in or disposed directly above the gross agitation well such that paint and cleaning solution expelled from a brush on the gross agitation surface is directed into the gross agitation well, F. wherein the upper portion of the removable insert includes the fine agitation surface, the fine agitation surface including one or more textured surfaces comprising protrusions and being sloped from an upper edge toward the lower portion and terminating at a lower edge, and wherein the entirety of the lower edge is disposed with respect to the fine agitation well such that paint and cleaning solution expelled from a brush on the fine agitation surface is directed into the fine agitation well, and G. wherein the dividers defining the plurality of cleaning solution wells contact the inner surface of the base along a sufficient length of their respective base contact edges to substantially isolate each of the plurality of cleaning solution wells such that paint released from a brush into any of the plurality of cleaning solution wells is substantially prevented from contaminating any of the other of the plurality of cleaning solution wells; and iii. a lid, wherein the lid and the base are configured to create a seal;

b. adding a brush cleaning solution to each of the plurality of cleaning solution wells;

c. dipping a brush, which contains paint, in the cleaning solution contained within the gross agitation well;

d. agitating the brush on the gross agitation surface;

e. repeating steps c and d until a substantial amount of the paint is removed from the brush;

f. dipping the brush in the cleaning solution contained within the fine agitation well;

g. agitating a brush on the fine agitation surface; and h. repeating steps f and g until substantially all of the paint is removed from the brush.

10. The method of claim 9 wherein the protrusions include raised dimples.

11. The method of claim 9 wherein the protrusions include ridges.

12. The method of claim 9 wherein the protrusions include a combination of ridges and raised dimples.

13. The method of claim 9 wherein the brush cleaning device further comprises one or more securing devices and wherein the one or more securing devices secure the lid to the base to maintain the seal.

14. The method of claim 13 wherein the one or more securing devices are one or more clips.

15. The method of claim 9 wherein the brush cleaning device further comprises a plurality of feet.

* * * * *